US006342029B1

(12) United States Patent
Richards

(10) Patent No.: US 6,342,029 B1
(45) Date of Patent: Jan. 29, 2002

(54) RUNNERS STARTING BLOCK

(76) Inventor: Lawrence W. Richards, 620 N. Willowspring Dr., Encinitas, CA (US) 92024

( * ) Notice: Subject to any disclaimer, the term of this patent is extended or adjusted under 35 U.S.C. 154(b) by 9 days.

(21) Appl. No.: 09/603,096

(22) Filed: Jun. 26, 2000

Related U.S. Application Data

(63) Continuation-in-part of application No. 09/027,995, filed on Feb. 23, 1998, now abandoned.

(51) Int. Cl.[7] ..... A63B 3/02
(52) U.S. Cl. ..... 482/19; 482/14
(58) Field of Search ..... 482/19

(56) References Cited

U.S. PATENT DOCUMENTS 1,990,497 A * 2/1935 Niday
2,004,172 A * 6/1935 Niday
2,144,962 A * 1/1939 Bresnahan
4,089,519 A * 5/1978 Newton, Jr. ..... 482/19
4,561,650 A * 12/1985 Newton, Jr. ..... 482/19
4,611,803 A * 9/1986 Newton, Jr. ..... 482/19
4,754,965 A * 7/1988 Moye ..... 482/19
5,342,259 A * 8/1994 Crichton ..... 482/19

* cited by examiner

*Primary Examiner*—Jerome W. Donnelly
*Assistant Examiner*—Lori Baker Amerson
(74) *Attorney, Agent, or Firm*—Steven W. Webb

(57) ABSTRACT

A runners starting block is disclosed that can be used separate from an anchor bar, each block to be individually positioned on the track, each block capable of being adjusted over a wide range of foot support angles, the starting blocks usable on artificial surfaces as well as natural ones.

1 Claim, 6 Drawing Sheets

RUNNERS STARTING BLOCK

CROSS-REFERENCES TO RELATED APPLICATIONS

This application is a Continuation-in-Part of U.S. patent application Ser. No. 09/027,995, filed Feb. 23, 1998, which is now abandoned.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to runners' training devices, methods, and techniques, and in particular relates to apparatuses for improving runners' starting posture, positioning and placement on the running track.

1. Field of the Invention

Starting blocks are crucially important devices to runners in sprint-type events, aiding in quicker starts and better starting technique. Runners on dirt tracks have dug holes or trenches in the dirt to give their feet traction, or used specially-developed apparatuses that were affixed to the dirt track by long spikes. With the advent of synthetic running tracks, runners starting block designers have developed an elongated alignment bar with foot placement blocks attached, the entire assembly braced on the track with short spikes.

2. Description of the Related Art

Previous inventions in this field have consisted of re-designs or modifications of the fundamental design consisting of a single alignment bar or base substrate to which are connected blocks for foot placement. The essential parameters of this design are found in U.S. Pat. Nos. 4,754,965 and 4,913,420 by C. W. Moye and U.S. Pat. Nos. 5,033,738 and 4,611,803 by M. A. Newton. The later Newton patent teaches a removable block, detachable from the central alignment bar. Newton U.S. Pat. No. 4,611,803 teaches a block with a limited degree of foot contact plate adjustment or tilt, implemented by means of an elevating shaft using a screw mechanism to alter the angle of repose of the foot. This mechanism is too complicated to be practical and the mechanism develops too high a degree of "free play", allowing foot position to migrate.

I. V. Crichton of South Africa in Patent #5,342,259 shows a starting block including a base member mountable on a substrate and a contiguous upper heel support with a screw adjustment for heel placement.

These starting blocks suffer from several disadvantages in that they are generally complicated and expensive to manufacture, they are difficult to repair, and they do not fit in a runner's equipment bag (are not easily portable) and hence runners must rely on race organizers to provide starting block equipment.

SUMMARY OF THE INVENTION

This invention provides an apparatus that replaces the traditional starting block with a more portable, adjustable starting block system. In particular, this apparatus provides a stronger, utilitarian starting block that is easier to manufacture, more adjustable in length of stance, truly portable, and allows the runner to widen his stance, unlike traditional starting blocks.

It is an object of this invention to provide a starting block that has a simple design, that is in consequence easier to manufacture, assemble, and repair.

It is also an object of this invention to provide a starting block that can be manufactured from only metal or synthetic (plastic) plates, hinges, and track spikes, requiring no complex parts.

It is a further object of this invention to provide a less expensive starting block for use by schools and athletes on a budget.

It is a further object of this invention to provide a starting block with unlimited adjustment for tilt In foot placement on the block, as well as unlimited adjustment for width of stance.

It is a further object of this invention to provide, due to its size and weight, a fully portable, easily carried and stored starting block system.

BRIEF DESCRIPTION OF THE DRAWINGS

The accompanying drawings show a complete embodiment of the invention according to the best mode so far devised for this invention. The drawings also include a variant of the best mode which is also claimed.

DETAILED DESCRIPTION OF THE INVENTION

Figure 1:
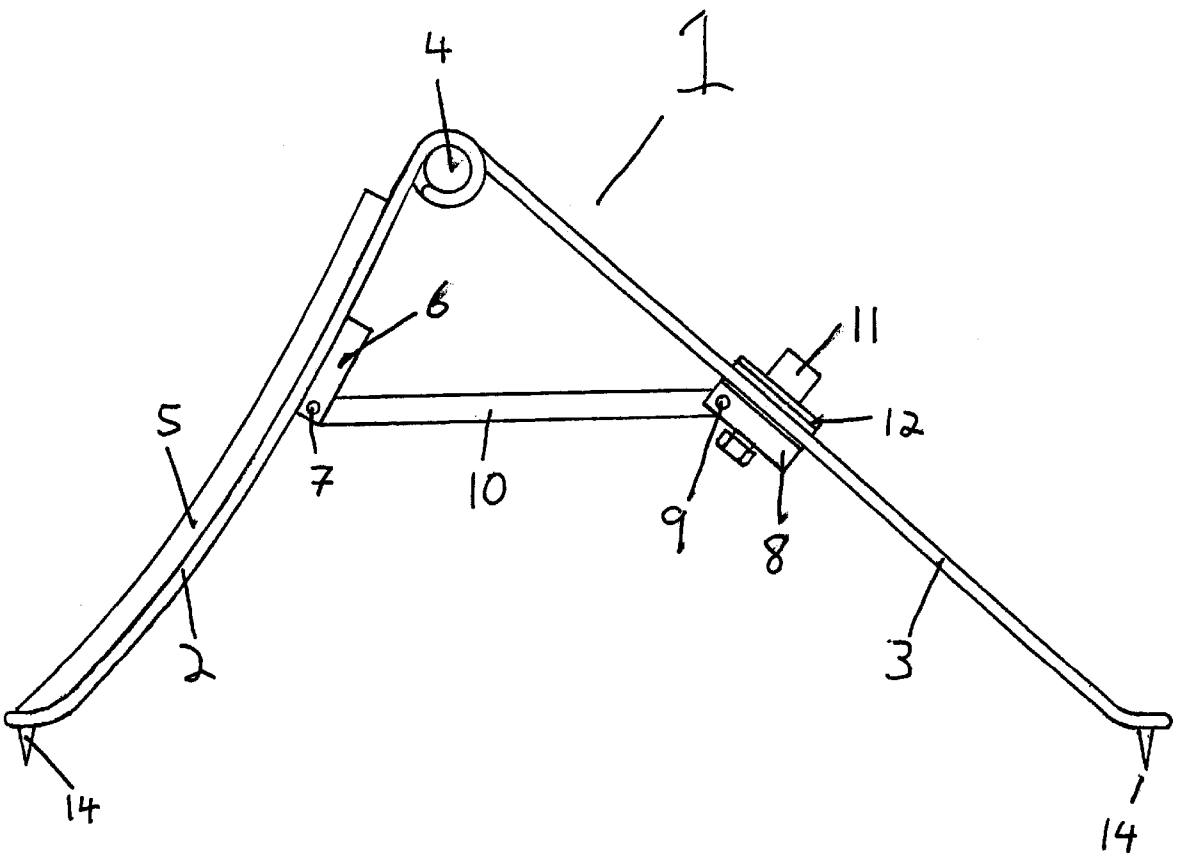
FIG. 1 is a side view of the apparatus with the stanchions extended in normal position.
Figure 2:
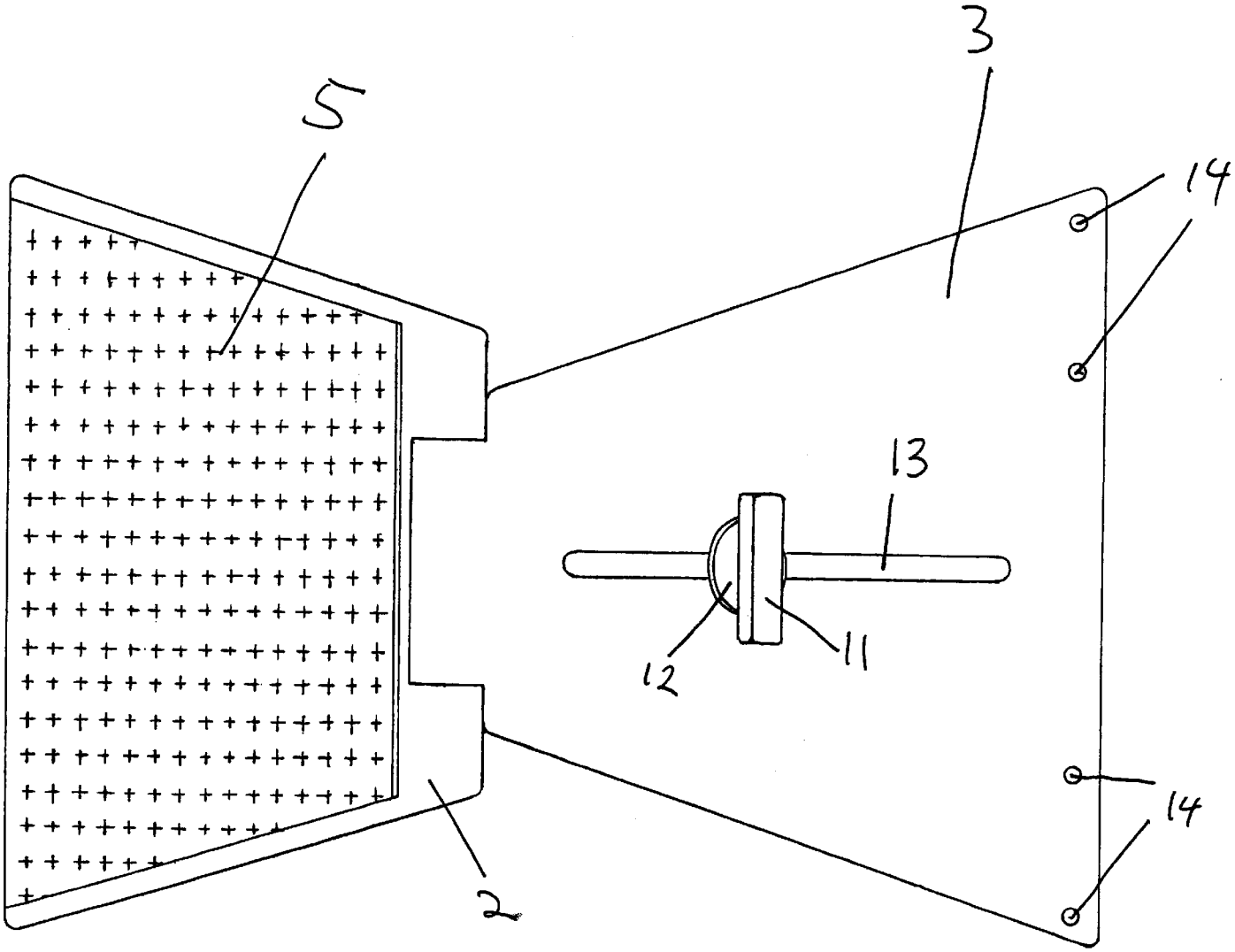
FIG. 2 is a top view of the apparatus with the stanchions extended in normal position.

The preferred embodiment of the starting block 1 is shown in FIG. 1. It includes a front support stanchion 2 that is shaped as shown in profile in FIG. 1, with a bent section at one end where spikes 14 are attached and a hinge portion at the other end which is curved to accept a support hinge pin 4. Similarly, the starting block includes a rear support stanchion 3 that is proportionally longer than the front support stanchion 2, for better support of the runners weight, and which is similarly fashioned with a bent section at one end for spike 14 attachment and a curved opposite end that will accept the support hinge pin 4. In FIG. 2 is shown the front support stanchion with a front support pad 5 fixedly attached to its upper surface, the pad made out of a non-skid material for traction. The front and rear support stanchions 2,3 are cast from a single piece of material, metal or plastic, such that the support hinge pin 4 accepting ends are integral with the stanchion body and need not be welded or glued on.

As seen in FIG. 1, attached fixedly to the lower surface of the front support stanchion 2 is a front plate anchor 6 which is connected to the sliding adjustment arm 10 by an anchor hinge pin 7, around which the sliding adjustment arm can rotate. The other end of the sliding adjustment arm 10 is connected to the sliding block 8 by means of the sliding block hinge pin 9. This end of the sliding adjustment arm can rotate around the sliding block hinge pin. The sliding block 8 slides up and down the rear support stanchion slot 13 by means of the tightening screw 11, which passes through the slot from the upper surface of the rear stanchion 3 to screw into the sliding block. There are several washers 12 that fit between the screw knob and the upper surface of the rear stanchion.

Figure 3:
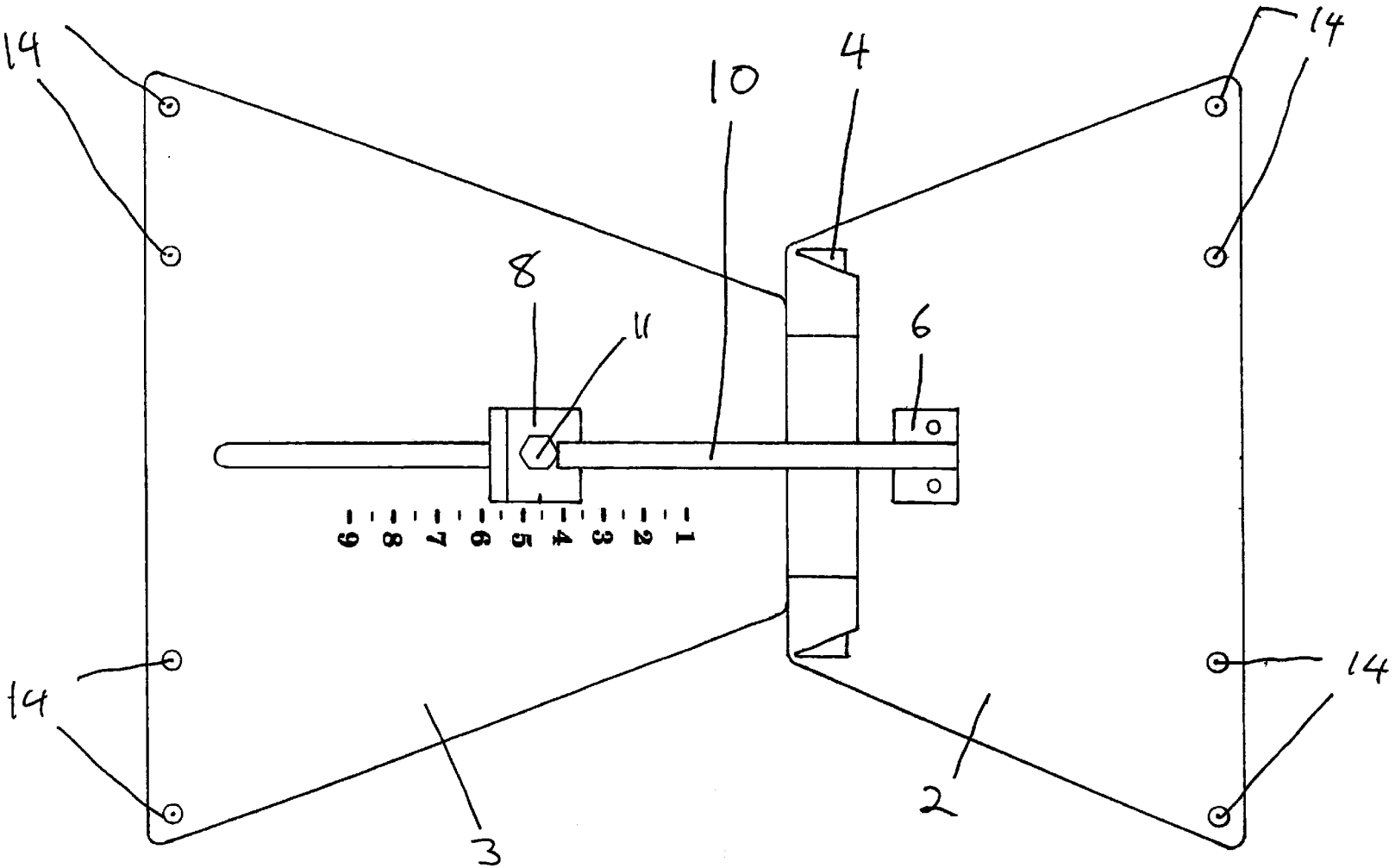
FIG. 3 is a view from underneath the apparatus with the stanchions extended in normal position.
Figure 5:
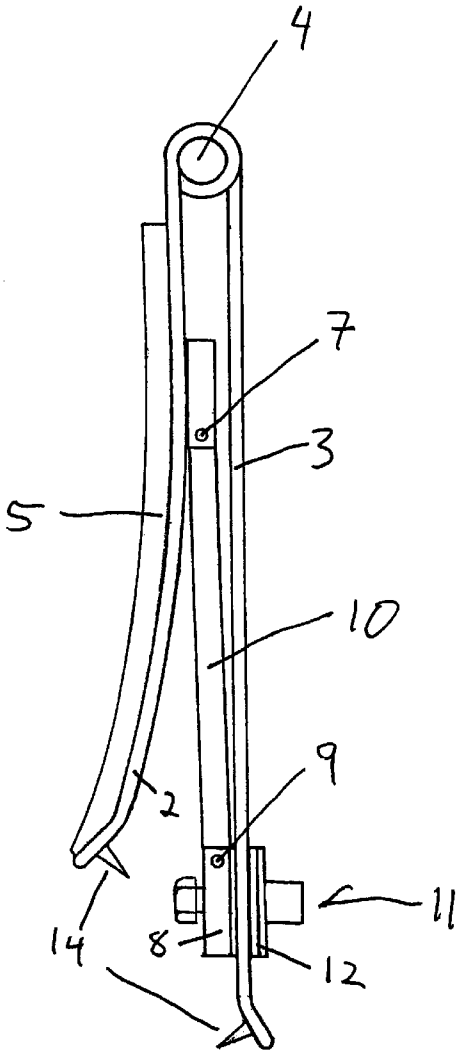
FIG. 5 is a side view of the apparatus with the stanchions folded closed for storage or carrying.
Figure 4:
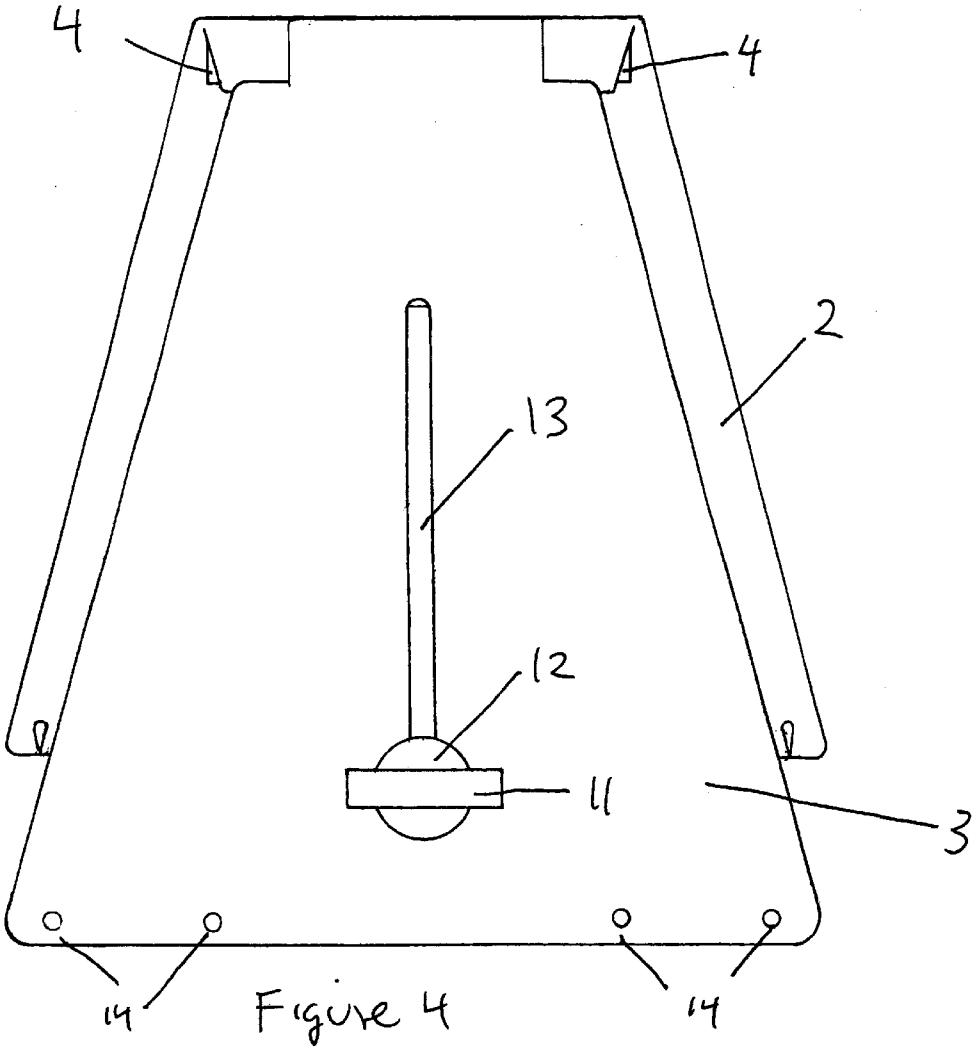
FIG. 4 is view looking directly at the rear support stanchion with the stanchions folded.

FIG. 2 shows a top view of the invention, revealing the rear support stanchion slot placement and the screw knob. FIG. 3 shows the underside of the invention with the sliding block in the middle of the slot. FIG. 4 and FIG. 5 show the invention with the stanchions folded.

Figure 6:
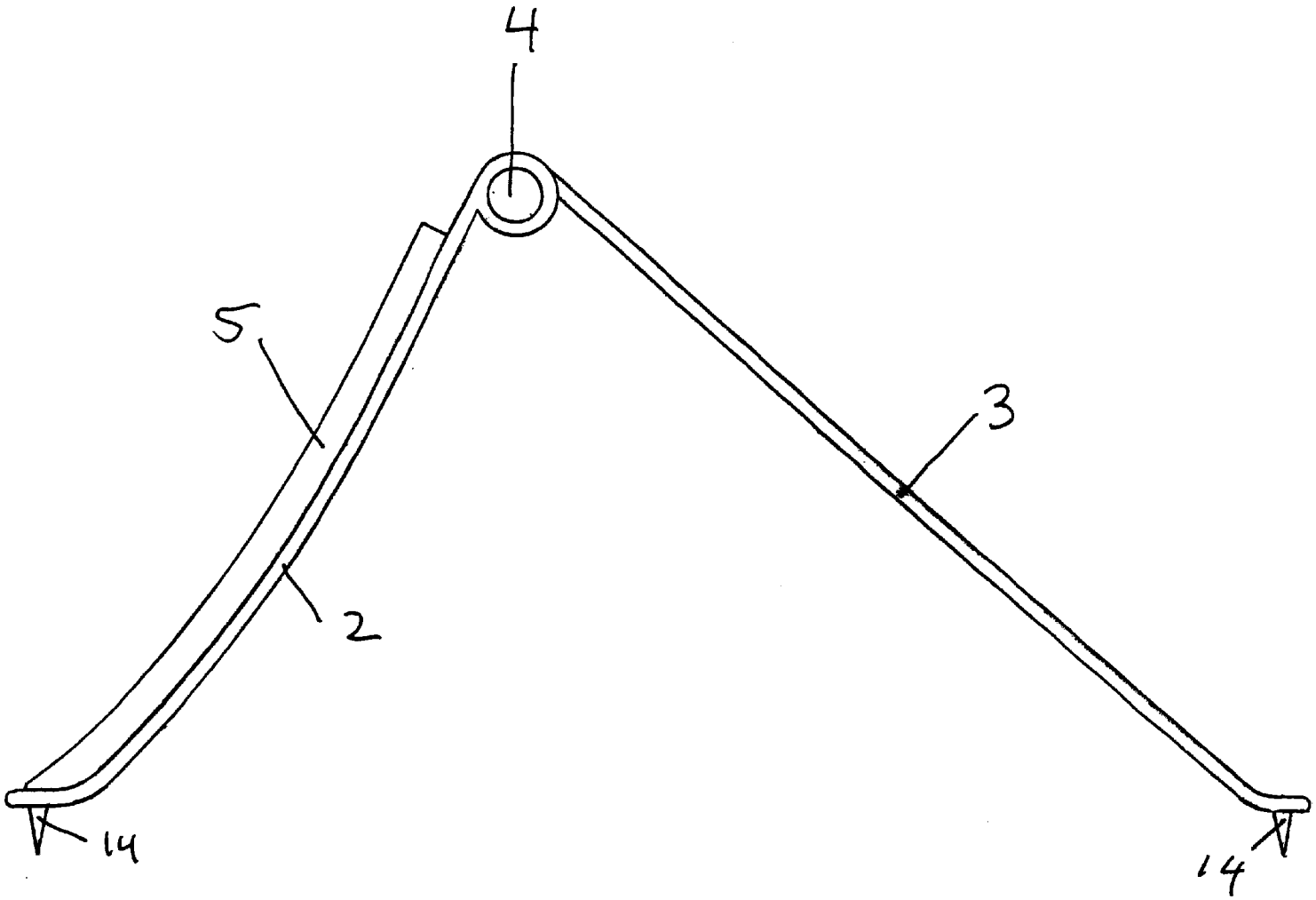
FIG. 6 is a side view of an alternate implementation of the invention, without the adjustment slide and block.
Figure 7:
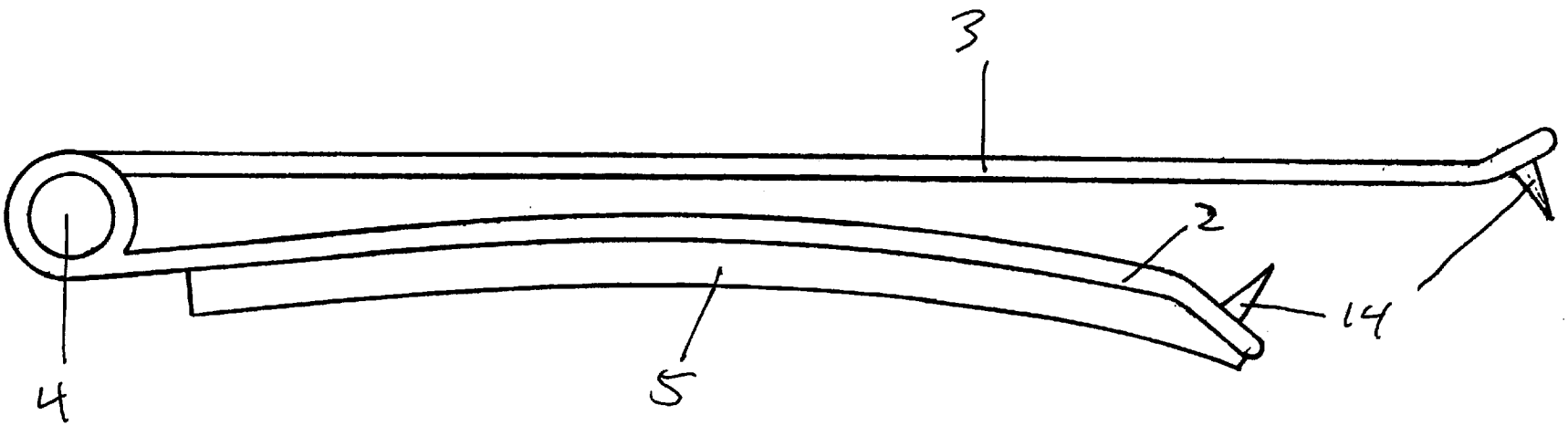
FIG. 7 is a side view of the alternative implementation with the stanchions closed.

FIG. 6 and FIG. 7 show side views of the alternate embodiment, without a slot, sliding block, sliding adjustment arm, or screw.

What is claimed is:

1. A starting block comprising a front support stanchion and a rear support stanchion, said front support stanchion and said rear support stanchion connected to each other in a hinged manner at one end of each by means of a support hinge pin, said front support stanchion possessing a plurality of spikes at the end of said front support stanchion away from said hinge pin, said rear support stanchion also possessing a plurality of spikes at the end of said rear support stanchion away from said hinge pin, said front support stanchion possessing an upper surface and a lower surface, said front support stanchion upper surface having a front support pad fixedly attached to it said front support stanchion lower surface having a front plate anchor fixedly attached to it, said front plate anchor rotatingly attached to a sliding adjustment arm by means of an anchor hinge pin, said sliding adjustment arm possessing a front support end and a rear support end, said anchor hinge pin passing through the body of said front plate anchor and said front support end of said sliding adjustment arm, said rear support stanchion possessing a rear support stanchion slot, said rear support stanchion slot comprising an elongated, longitudinal hole through the body of said rear support stanchion, said sliding adjustment arm rear support end rotatingly attached to a sliding block by means of a sliding block hinge pin, said sliding block hinge pin passing through the body of said sliding block and said rear support end of said sliding adjustment arm, said rear support stanchion possessing an upper surface and a lower surface, said sliding block held close to said rear support stanchion lower surface by means of a tightening screw, said tightening screw possessing a knob end and a screw end, said screw and connected to said sliding block by passing through said rear support stanchion slot from said rear support stanchion upper surface to said rear support stanchion lower surface and shrewdly attaching to said sliding block, said tightening screw knob end remaining on the rear support stanchion upper surface, a plurality of washers inserted between said tightening screw knob end and said rear support stanchion upper surface.

* * * * *